US008555788B2

(12) United States Patent
Kleinklaus et al.

(10) Patent No.: US 8,555,788 B2
(45) Date of Patent: Oct. 15, 2013

(54) TABLE INCLUDING AT LEAST ONE LEG THAT CAN BE TURNED EITHER WAY UP

(75) Inventors: Norbert Kleinklaus, Viry (FR); Fabrice Lambert, Vaux en Bugey (FR)

(73) Assignee: Grosfillex SAS, Arbent (FR)

( * ) Notice: Subject to any disclaimer, the term of this patent is extended or adjusted under 35 U.S.C. 154(b) by 0 days.

(21) Appl. No.: 13/489,532

(22) Filed: Jun. 6, 2012

(65) Prior Publication Data

US 2013/0139737 A1 Jun. 6, 2013

(30) Foreign Application Priority Data

Jun. 6, 2011 (FR) ..... 11 54906

(51) Int. Cl.
*A47B 3/00* (2006.01)

(52) U.S. Cl.
USPC ..... 108/115; 108/169; 108/35

(58) Field of Classification Search
USPC ..... 108/36, 35, 34, 33, 38, 41, 115, 162, 108/166, 167, 168, 169, 170, 171, 173, 174, 108/175
See application file for complete search history.

(56) References Cited

U.S. PATENT DOCUMENTS

| | | | | | |
|---|---|---|---|---|---|
| 365,034 | A | * | 6/1887 | Woodruff | 108/36 |
| 564,936 | A | * | 7/1896 | Odell | 108/35 |
| 1,062,996 | A | | 5/1913 | Sornberger | |
| 1,516,323 | A | | 11/1924 | Bilton | |
| 2,326,461 | A | * | 8/1943 | Howe | 108/36 |
| 2,868,598 | A | | 1/1959 | Karoff | |
| 2,873,987 | A | * | 2/1959 | Larson | 108/115 |
| 2,925,140 | A | | 2/1960 | Thielepape | |
| 3,029,114 | A | | 4/1962 | Sanchez | |
| 3,143,982 | A | | 8/1964 | Blink et al. | |
| 3,148,639 | A | * | 9/1964 | Nadal et al. | 108/169 |
| 3,162,149 | A | | 12/1964 | Hansen | |
| 3,308,773 | A | | 3/1967 | Long | |
| 3,473,492 | A | | 10/1969 | Sanchez | |
| 3,520,259 | A | | 7/1970 | Sanchez | |
| 3,606,845 | A | | 9/1971 | Hickman | |
| 3,817,191 | A | | 6/1974 | Hansen et al. | |
| 4,643,103 | A | * | 2/1987 | Jorgensen | 108/36 |
| 5,325,793 | A | | 7/1994 | Martin | |
| 5,421,272 | A | | 6/1995 | Wilmore | |
| 5,501,157 | A | | 3/1996 | Westerburgen | |
| 5,524,555 | A | | 6/1996 | Fanuzzi | |

(Continued)

FOREIGN PATENT DOCUMENTS

| | | |
|---|---|---|
| FR | 1283277 | 2/1962 |
| FR | 2835161 | 8/2003 |
| GB | 1367797 | 9/1974 |
| WO | 2008000051 A2 | 1/2008 |

*Primary Examiner* — Jose V Chen
(74) *Attorney, Agent, or Firm* — Nelson Mullins Riley & Scarborough, LLP

(57) ABSTRACT

In one aspect, the present invention provides a table comprising a tabletop and at least first and second legs, at least the first leg of which is a moving leg, said table further comprising a connecting strut connected to the tabletop via a first horizontal axis and to the first leg via a second horizontal axis, so that, starting from a first position in which its first end and its second end face respectively towards the tabletop and towards the floor, the first leg is suitable for being turned over by pivoting about the second axis of the connecting strut so as to take up a second position in which its first end and its second end face respectively towards the floor and towards the tabletop.

14 Claims, 9 Drawing Sheets

(56) References Cited

U.S. PATENT DOCUMENTS

| | | | | |
|---|---|---|---|---|
| 6,032,585 | A | 3/2000 | Pinch | |
| 6,041,723 | A | 3/2000 | Peterson | |
| 6,431,086 | B1 * | 8/2002 | Lloyd | 108/36 |
| 6,494,147 | B1 | 12/2002 | Schulte et al. | |
| 7,757,617 | B2 * | 7/2010 | Larcom et al. | 108/169 |
| 2002/0100397 | A1 | 8/2002 | Chang | |
| 2005/0155534 | A1 | 7/2005 | Lin et al. | |
| 2005/0160952 | A1 | 7/2005 | Tsai | |
| 2006/0005748 | A1 | 1/2006 | Christians | |
| 2007/0272128 | A1 | 11/2007 | Lin | |
| 2009/0000522 | A1 * | 1/2009 | Collins et al. | 108/12 |

* cited by examiner

FIG.1
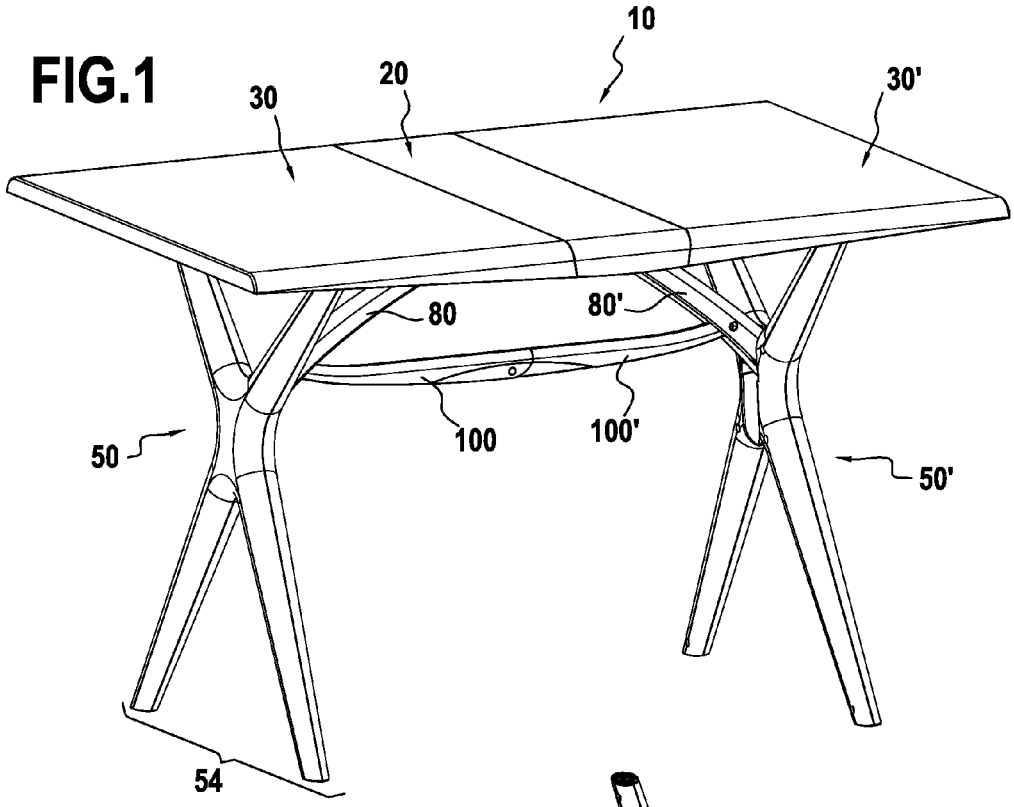
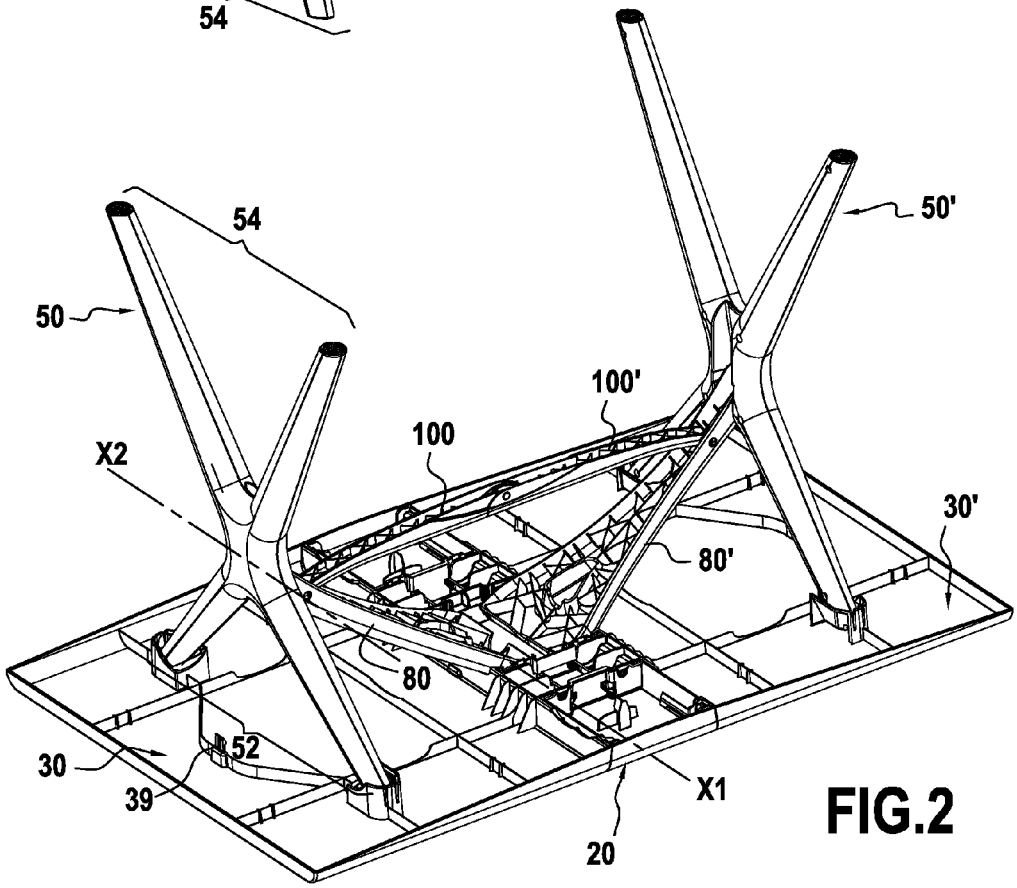
FIG.2

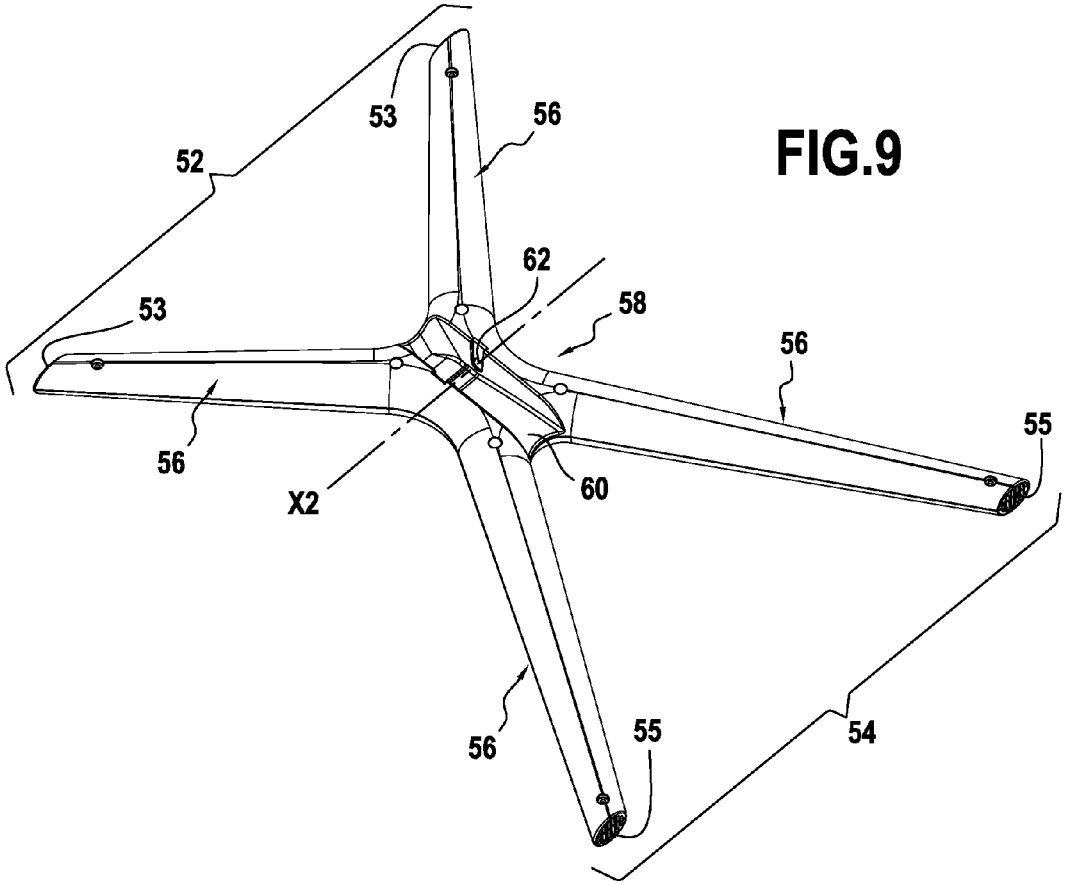
FIG.9
FIG.10
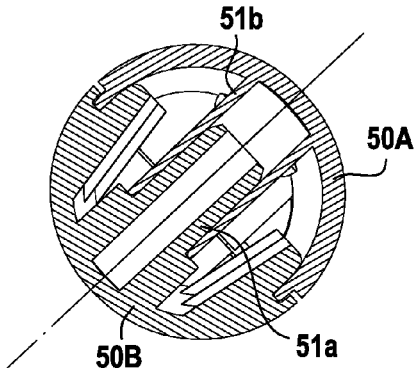

TABLE INCLUDING AT LEAST ONE LEG THAT CAN BE TURNED EITHER WAY UP

The present invention relates to the field of tables, and more particularly to the field of tables having a tabletop and one or more moving legs.

BACKGROUND OF THE INVENTION

Such tables are already known that are conventionally characterized in that the moving leg, if the table has only one moving leg, or each of the moving legs, if the table has a plurality of moving legs, is suitable for being moved to take up at least one predetermined position in which the table finds itself in a stable in-use configuration.

All such known tables suffer from the same defect of implementing moving connections or linkages for the moving leg that allow it to move only to a limited extent, resulting in various drawbacks inherent to the movements used.

For example, consideration is given below to the particular conventional moving connections disclosed in U.S. Pat. No. 1,516,323.

In that patent, the table has a foldable rectangular tabletop and two moving legs, both of which are suitable for pivoting about associated vertical axes, so that each of the two moving legs can be arranged either in the lateral direction of the tabletop, when the tabletop is to be folded, or in the longitudinal direction of the tabletop, when it is desired to deploy said tabletop.

In that type of table, in particular for reasons of compactness and of pleasing appearance, it is necessary for the two moving legs not to extend beyond the tabletop when they are disposed in the lateral direction thereof.

As a result of the small extent of movement allowed by the moving connections in accordance with that patent, the span (i.e. the distance between the legs) of the table in its configuration with its tabletop deployed is limited by the width of the tabletop.

Therefore, the small extent of movement of the moving legs of a table in accordance with that patent requires the designer to choose between either guaranteeing good stability of the table in its configuration with its tabletop deployed or else obtaining a tabletop having a long length.

OBJECT AND BRIEF SUMMARY OF THE INVENTION

Therefore, there is a pressing need to develop novel moving connections for movement of a moving leg of a table that allows said leg to move to a greater extent.

The present invention proposes to provide such novel moving connections.

More particularly, a table of the present invention comprises a tabletop; at least first and second legs, at least the first leg of which is a moving leg; and a connecting strut connected to the tabletop via a first horizontal axis and to the first leg via a second horizontal axis, so that, starting from a first position in which its first end and its second end face respectively towards the tabletop and towards the floor, the first leg is suitable for being turned over by pivoting about the second axis of the connecting strut so as to take up a second position in which its first end and its second end face respectively towards the floor and towards the tabletop.

The term "horizontal" is used to mean a direction that is substantially parallel to the top face of the tabletop (i.e. the face of the tabletop that is designed to serve as the usable surface of the table, and on which articles can be placed) and to the plane of the floor, when the table is stood on its legs on a floor that is assumed to be horizontal.

Similarly, the adjective "vertical" is used to describe a direction that is substantially perpendicular to the top face of the tabletop and to the plane of the floor, when the table is stood on its legs on a floor that is assumed to be horizontal.

In addition, any direction that is parallel to the first and second axes is referred to below as the "lateral" direction.

Similarly, any direction that is horizontal and perpendicular to the first and second axes is referred to below as the "longitudinal" direction.

It can be understood that, in accordance with the present invention, the first leg is not connected directly to the tabletop but rather it is connected thereto via a connecting strut.

Thus, the first leg is suitable for pivoting relative to the connecting strut that is itself suitable for pivoting relative to the tabletop.

As a result, the extent to which the first leg can move within the reference frame of the tabletop is increased.

The first leg can thus move away from and towards the first axis to an extent that depends only on the spacing between the axes of the connecting strut (the distance between the first axis and the second axis).

It is thus possible to obtain at least one stable configuration for the table, in which configuration the distance between the first and second legs does not depend on the dimensions of the tabletop.

As a result, it is possible to optimize simultaneously the span of the table and the dimensions of the tabletop.

Although it is not excluded from the ambit of the present invention for the first leg and/or the connecting strut also to be movable in translation in the lateral direction of the table during their respective movements between the first and the second position of the first leg (e.g. for enabling the first leg to be locked/unlocked in its first or second position), it is nevertheless preferable to prevent such movements in translation in order to increase the robustness of the table.

In addition, the first leg is suitable for being turned over by pivoting about the second axis of the connecting strut so as to go from a first position in which its first end and its second end face respectively towards the tabletop and towards the floor, to a second position in which its first end and its second end face respectively towards the floor and towards the tabletop.

It can therefore be understood that the extent to which the first leg can pivot relative to the connecting strut can thus be increased.

It can also be understood that the first and second ends of the first leg are both free to move relative to the tabletop while also making it possible, in the first position, for the tabletop to rest on the first end of the first leg.

Given this freedom of movement of the first and second ends of the first leg relative to the tabletop, the table may advantageously further comprise keying means for keying the first end of the first leg relative to the tabletop in the first position, so as to prevent any untimely movement of the first leg once said first leg has taken up its first position.

As a result, the stability of the table may thus be improved when the first leg is in its first position.

Advantageously, the connecting strut is connected to the first leg at a place thereon that is situated between its first and second ends (at an intermediate position on the first leg that lies between the first end and the second end of the first leg) and some distance away from said first and second ends.

It can thus be understood that the first and second ends of the first leg can both describe circular paths within the reference frame of the connecting strut.

In addition, the fact that the first leg can be turned over may be used advantageously so that the table is suitable for resting on the first leg not only when said first leg takes up its first position but also when it takes up its second position.

Therefore, the tabletop may advantageously bear against the second end of the first leg when said first leg is in its second position, in such a manner as to increase the rigidity and the stability of the table in this configuration.

The table may then advantageously further comprise keying means for keying the second end of the first leg relative to the tabletop in the second position, in such a manner as to avoid any untimely movement of the first leg and thus in such a manner as to increase the stability of the table when the first leg is in its second position.

In addition, since the first leg is connected to the connecting strut via a pivot connection having the second axis as its axis, the first leg forms a first angle with the connecting strut when it takes up its first position, and forms a second angle distinct from the first angle with the connecting strut when it takes up its second position.

It should be understood that, in the meaning of the present invention, any value may be chosen for the first angle and any value may be chosen for the second angle, with the sole proviso that, starting from a first position in which its first end and its second end face respectively towards the tabletop and towards the floor, the first leg can be turned over by pivoting about the second axis of the connecting strut so as to take up a second position in which its first end and its second end face respectively towards the floor and towards the tabletop.

By way of non-limiting example, the second angle may be chosen to be close to zero (in particular less than 10° in absolute value terms), in such a manner that, when the first leg is in its second position, said first leg is substantially parallel to the connecting strut.

It is thus possible to increase the compactness of the assembly made up of the first leg and of its connecting strut, when the first leg takes up its second position.

In order to increase this compactness further, it is then advantageous for the first leg to be provided with a setback in which at least a portion of the connecting strut is received when the first leg takes up its second position.

Advantageously, but not necessarily, the first leg is substantially plane. The second axis and the first and second ends of the first leg then lie substantially within this plane.

The plane of the first leg may then advantageously be substantially vertical when the first leg takes up its first position.

Similarly, the plane of the first leg may advantageously be substantially vertical when the first leg takes up its second position.

It can be understood that these particular arrangements make it possible to minimize the torsion torque exerted by the weight of the tabletop on the first leg.

In addition, the tabletop may advantageously be non-deformable (i.e. be constituted by a unit that moves as a whole), e.g. made integrally in one piece, which is less costly but makes the table less compact to store.

The table can then advantageously have a sub-structure to which is connected the first leg via its connecting strut and the second leg. The tabletop can then be mounted to be stationary on said sub-structure when it is desired to assemble the table for the purpose of using it. The tabletop can also be detached from said sub-structure when it is desired to disassemble the table for the purposes of storing it. The tabletop is then stored separately from the sub-structure which can occupy a minimized volume by making advantageous use of the moving connections of the present invention in such a manner that, in its second position, the first leg is close to the second leg.

By way of advantageous alternative, the tabletop has a support portion that carries the first axis of the connecting strut, and at least a first folding portion mounted to pivot relative to the support portion in such a manner as to be able to move between an unfolded configuration in which the first leg can be placed under the first folding portion, and a folded configuration in which the first leg is placed under the support portion.

It can be understood that the first position of the first leg is obtained when said first leg is placed under the first folding portion in its unfolded configuration, while the second position of the first leg is obtained when said first leg is placed under the support portion in such a manner as to enable the first folding portion to be folded.

As a result, the mobility of the first leg can thus be used advantageously to disengage said leg from under the first folding portion in such a manner as to enable said first folding portion to be folded.

In its unfolded configuration, the first folding portion can advantageously come to bear against the first end of the first leg, when said first leg takes up its first position, in such a manner that the first leg takes part in holding the first folding portion in its unfolded configuration.

In addition, the table may advantageously further comprise means for securely retaining the first folding portion in its unfolded configuration.

Similarly, the table may advantageously further comprise means for securely retaining the first folding portion in its folded configuration.

Advantageously, the second leg of the table is a stationary leg. It can thus be understood that it is always the same ends of the second leg that face respectively towards the tabletop and towards the floor.

By way of advantageous alternative, the second leg is a moving leg.

It is then advantageously possible to choose any moving connections for the second leg.

However, it is preferable for said second moving leg to be analogous to the first leg, in such a manner that its extent of movement is also maximized and in such a manner as to optimize the overall appearance of the table.

The table then further comprises another connecting strut that is associated with the second leg and that is analogous to the connecting strut associated with the first leg.

The term "analogous" is used to indicate that the second leg and the connecting strut that is associated with it may advantageously and arbitrarily have one or more characteristics from among all of the characteristics that are described above or below in the present patent application in association with the first leg and with its connecting strut.

In particular, the table may advantageously be such that, starting from a first position in which its first end and its second end face respectively towards the tabletop and towards the floor, the second leg is suitable for being turned over by pivoting about the second axis of its connecting strut so as to take up a second position in which its first end and its second end face respectively towards the floor and towards the tabletop.

In addition, the tabletop may advantageously have a second folding portion mounted to pivot relative to the support portion, on the side opposite from the side on which the first folding portion is connected to the support portion, in such a manner that the second folding portion can move between an unfolded configuration in which the second leg can be placed under the second folding portion and a folded configuration in which the second leg is placed under the support portion.

Advantageously, the table is in a stable position both when the first leg is in its first position and also when said first leg takes up its second position.

For this purpose, it is possible, for example, to adapt the dimensions of the connecting strut and of the first leg, and the positioning of the places where the connecting strut is connected to the tabletop (the position of the first axis) and where the connecting strut is connected to the first leg (the position of the second axis), in such a manner that the vertical distance between the tabletop and the second end of the first leg in its first position is substantially equal to the vertical distance between the tabletop and the first end of the first leg in its second position.

It then suffices for this vertical distance to be substantially equal to the vertical distance between the tabletop and that one of the two ends of the second leg that permanently faces towards the floor, when the second leg is a stationary leg.

Similarly, when the second leg is a moving leg analogous to the first leg, the table may advantageously be in a stable position when one of the first and second legs is in its first position, while the other of said legs is in its second position.

For this purpose, it is possible, for example, to adapt the dimensions of the second leg and of its connecting strut and the positioning of the places where said connecting strut is connected to the tabletop and where said connecting strut is connected to the second leg, in a manner analogous to the manner described above.

In addition, when the tabletop has a support portion and at least a first folding portion, the table may advantageously be stable both when the first folding portion is in the unfolded configuration and when it is in the folded configuration, and the table can then be used as a console table that is compact, the usable surface of said console table, on which surface articles can be placed, being formed by the support portion.

In addition, when the second leg is a moving leg that is analogous to the first leg, the table may advantageously further comprise at least one scissor-type stay having two branches suitable for being splayed out between the first and second legs in their first positions so as to hold said legs apart.

It can be understood that such a scissor-type stay can thus take up a configuration in which its two branches are splayed out between the first and second legs, when said first legs are both in their first positions.

As a result, such a scissor-type stay makes it possible for the table to become more rigid in this configuration, and to make it more stable while preventing any untimely movement of the two legs.

In addition, provision may advantageously be made for the scissor-type stay to have a hard spot for holding its two branches in their splayed-out configuration between the first and second legs.

It can thus be understood that this hard spot embodies means for holding the two branches of the scissor-type stay in their splayed-out configuration, which hard spot the user must overcome by applying a force whenever said user wishes to fold the two branches of the scissor-type stay in order to enable the first and second legs to change position.

Advantageously, the two branches of the scissor-type stay are mounted to pivot respectively on the connecting strut of the first leg and on the connecting strut of the second leg.

Advantageously, the two branches of the scissor-type stay are suitable for being brought together to bear respectively against the connecting strut of the first leg and against the connecting strut of the second leg when the two legs take up their second positions.

It can be understood that the compactness of two branches of the scissor-type stay can thus be maximized.

BRIEF DESCRIPTION OF THE DRAWINGS

The invention can be better understood and its advantages appear more clearly on reading the following detailed description of embodiments given by way of non-limiting example. The description refers to the accompanying drawings, in which:

FIG. 1 is a perspective view of a table in accordance with the present invention, with its legs in their first positions and the two folding portions of its tabletop in their unfolded configurations;

FIG. 2 is a perspective view seen from another angle of the table shown in FIG. 1, showing the underside of the tabletop;

FIG. 9 is a perspective view of a leg of the above table;

FIG. 10 is a section view on the axis X-X shown in FIG. 8;

MORE DETAILED DESCRIPTION

Figure 3:
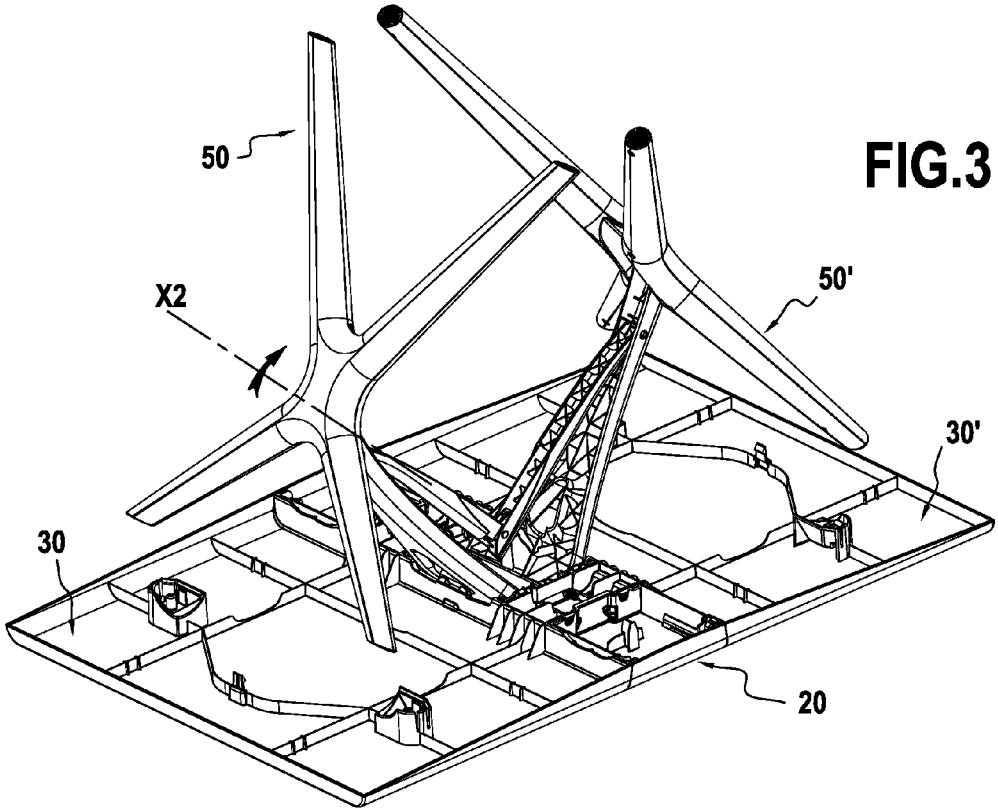
FIG. 3 is a view analogous to the FIG. 2 view, and in which the two legs of the table are being turned over by pivoting.

FIG. 1 shows an example of a table in accordance with the present invention by way of non-limiting illustration.

In the example shown, the table comprises a tabletop 10 and two legs 50 and 50'.

The first leg 50 is a moving leg.

More precisely, the table further comprises a first connecting strut 80 connected to the tabletop 10 via a first horizontal axis X1 and to the first leg 50 via a second horizontal axis X2, so that, starting from a first position in which its first end 52 and its second end 54 face respectively towards the tabletop 10 and towards the floor, the first leg 50 is suitable for being turned over by pivoting about the second axis X2 of the first connecting strut 80 so as to take up a second position in which its first end 52 and its second end 54 face respectively towards the floor and towards the tabletop 10.

In the example shown, the first position of the first leg 50 is a legs-apart position in which the distance between the first leg 50 and the first axis X1, in the longitudinal direction of the table, is the longest.

Similarly, in this example, the second position of the first leg 50 is a legs-together position in which the distance between the first leg 50 and the first axis X1, in the longitudinal direction of the table, is the shortest.

When the first leg 50 is in its first position, the tabletop 10 of the table rests on the first end 52 of the first leg 50, which end is facing towards the tabletop 10.

The first end 52 of the first leg 50 is embodied by a single bearing surface, or by a plurality of bearing surfaces 53 spaced apart in at least one direction, in particular the lateral direction of the table, which surfaces(s) is/are arranged in such a manner that the tabletop 10 bears against said bearing surface(s) when the first leg 50 takes up its first position.

In addition, when the first leg 50 is in its first position, the second end 54 of the first leg 50 faces towards the floor in such a manner as to be able to bear against the floor.

The second end 54 of the first leg 50 is embodied by a single bearing surface, or by a plurality of bearing surfaces 55 spaced apart in at least one direction, in particular the lateral direction of the table, which surfaces(s) is/are arranged in such a manner as to come to bear against the floor when the first leg 50 takes up its first position.

Advantageously, but not necessarily, the tabletop 10 of the table rests on the second end 54 of the first leg 50, which end faces towards the tabletop 10, when the first leg 50 is in its second position.

The tabletop 10 then bears against the bearing surface(s) 55 defining the second end 54 of the first leg 50.

In addition, when the first leg 50 is in its second position, the first end 52 of the first leg 50 faces towards the floor in such a manner as to be able to bear against the floor.

The bearing surface(s) 53 defining the first end 52 of the first leg 50 then come to bear against the floor when the first leg 50 takes up its second position.

In the example shown, in particular in FIG. 9, the first leg 50 comprises a central portion 58 that branches out into a plurality of spaced-apart branches 56.

More particularly, the first leg 50 has four branches 56 that are spaced apart in a manner such that the first leg 50 is substantially X-shaped.

However, without going beyond the ambit of the present invention, it is possible to provide any other arrangements and/or numbers of branches, in such a manner that the first leg 50 has an entirely different shape, e.g. an I-shape, a Y-shape, an H-shape, two upside-down T-shapes, or any other shape.

In this example, the first end 52 of the first leg 50 is embodied by two bearing surfaces 53 that are spaced apart in the lateral direction of the table, and that are formed respectively at that end of a first one of the four branches 56 that is further from the central portion 58, and at that end of a second one of the four branches 56 that is further from the central portion 58.

In this example, the second end 54 of the first leg 50 is embodied by two bearing surfaces 55 that are spaced apart in the lateral direction of the table, and that correspond respectively to that end of a third one of the four branches 56 that is further from the central portion 58, and to that end of the fourth branch 56 that is further from the central portion 58.

In addition, as shown in particular in FIGS. 1 and 2, the tabletop 10 of the table is made up of a support portion 20, and of two folding portions 30 and 30'.

Figure 4:
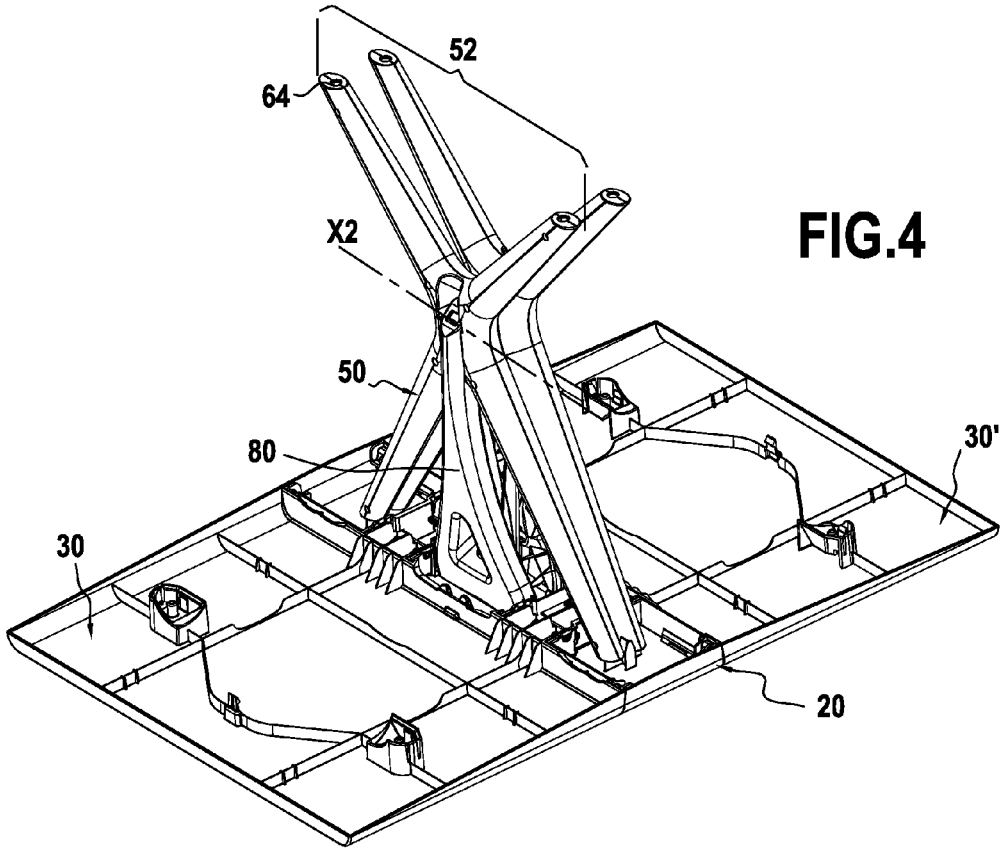
FIG. 4 is a view analogous to the FIG. 2 view, with the two legs of the table in their second positions.
Figure 5:
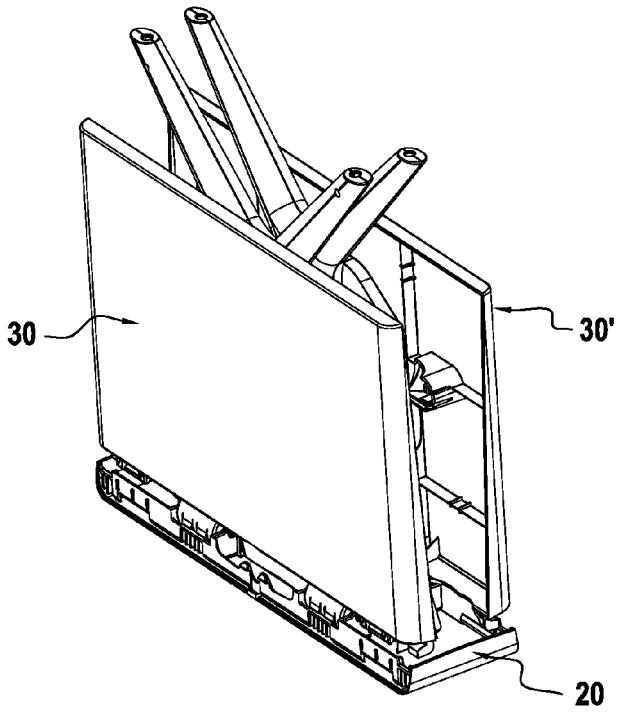
FIG. 5 is a view analogous to the FIG. 4 view, with the two folding portions of the tabletop in their folded configurations.

The first folding portion 30 is mounted to pivot relative to the support portion 20, in such a manner as to be able to move between an unfolded configuration that is shown in FIGS. 1 to 4, and a folded position that is shown in FIG. 5.

Figure 11:
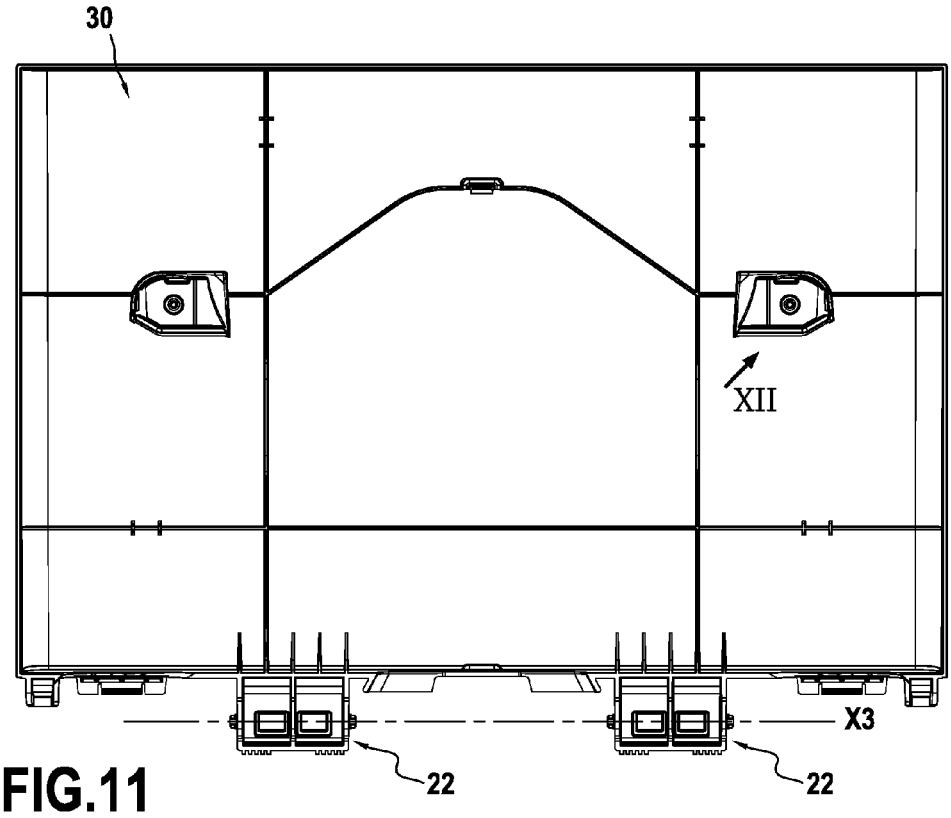
FIG. 11 is a plan view of one of the folding portions of the above table.

As shown in particular in FIG. 11, the first folding portion 30 is connected to the support portion 20 via a third axis X3 that extends in the lateral direction of the table and that is parallel to the first and second axes X1 and X2.

In the example shown, the first folding portion 30 and the support portion 20 are connected together via a pivot connection, that pivots about the third axis X3, and that prevents any relative movement of these portions in translation in the same direction as the third axis X3.

For this purpose, the connection between the first folding portion 30 and the support portion 20 is formed by means of a hinge set having one or more hinges 22, and in particular two hinges, that are secured to a lateral end of the first folding portion 30.

However, without going beyond the ambit of the present invention, it is possible to make provision to interconnect the first folding portion 30 and the support portion 20 via a connection of the sliding pivot type, e.g. so as to make it possible to lock/unlock the first folding portion 30 in the unfolded position.

In the non-limiting example shown, the tabletop 10 is substantially rectangular in shape and has two short sides in the lateral direction of the table, and two long sides in its longitudinal direction, when both of its folding portions 30, 30' are in their unfolded configurations.

For this purpose, the two folding portions 30, 30' and the support portion 20 are themselves of substantially rectangular shape.

However, without going beyond the ambit of the present invention, it is possible to provide an entirely different shape for the tabletop 10, e.g. a circular shape, oval shape, polygonal shape or some other shape.

In the example shown, the table has a plane of symmetry corresponding to the midplane of the support portion 20 that is parallel to the vertical and lateral directions of the table.

As a result, the second leg 50' is also a moving leg that is identical to the first leg 50, and that is connected to the tabletop 10 via a second connecting strut 80' identical to the first connecting strut 80.

Also as a result, the second folding portion 30' is identical to the first folding portion 30, and is mounted to pivot relative to the support portion 20, on the side that, in the longitudinal direction of the table, is opposite from the side on which the first folding portion 30 is connected to the support portion 20, in such a manner that the second folding portion 30' can also move between an unfolded configuration and a folded configuration.

It further results that the second leg 50' may have one or more of the characteristics described above or below in association with the first leg 50, so that the description of said characteristics is not repeated in association with the second leg 50'.

Similarly, the second connecting strut 80' may have one or more of the characteristics described above or below in association with the first connecting strut 80, so that the description of said characteristics is not repeated in association with the second connecting strut 80'.

The second folding portion 30' of the tabletop 10 may have one or more of the characteristics described above or below in association with the first folding portion 30, so that the description of said characteristics is not repeated in association with the second folding portion 30'.

In the example shown, the first connecting strut 80 and the second connecting strut 80' are both connected to the support portion 20 of the tabletop 10.

More precisely, the support portion 20 carries the first axis X1 of the first connecting strut 80 and the first axis of the second connecting strut 80', in such a manner that the first axis X1 of the first connecting strut 80 and the first axis of the second connecting strut 80' are spaced apart in the longitudinal direction of the table.

The movements of the first leg 50 as it goes from its first position to its second position are described below.

FIGS. 1 and 2 show the first leg 50 in its first position. This position is obtained when the first leg 50 is placed under the first folding portion 30 in its unfolded configuration.

Thus, when the first leg 50 takes up its first position, its first end 52 and its second end 54 face respectively towards the first folding portion 30 in its unfolded configuration, and towards the floor.

As indicated by the arrow in FIG. 3, when it is desired to cause the first leg 50 to go from its first position to its second position, it suffices to cause the first leg 50 to pivot about the second axis X2 of the first connecting strut 80.

In the example shown in FIG. 4, the second position of the first leg 50 is reached once said first leg has pivoted far enough to be turned over and to be placed under the support portion 20.

As a result of the first leg 50 turning over, and once said first leg takes up its second position, its first end 52 faces towards the floor, while its second end 54 faces towards the support portion 20 of the tabletop 10.

In the example shown, the first connecting strut 80 is pivoted relative to the tabletop 10 about the first axis X1, while the first leg 50 is going from its first position to its second position.

As shown in FIG. 5, once the first leg 50 is in its second position, it is possible to fold the first folding portion 30 of the tabletop 10 in such a manner that said first folding portion takes up its folded configuration.

When it is desired to cause the first leg to go from its second position to its first position, it then suffices to unfold the first folding portion 30 and to turn the first leg 50 over by pivoting it in the direction opposite from the direction indicated by the arrow in FIG. 3.

In addition, as shown in FIG. 1, the table is suitable for taking up a stable position (i.e. a position in which articles can be placed on at least a fraction of the top face of the tabletop, when the table is stood on a floor) in a first configuration that corresponds to its conventional in-use position. This configuration is obtained when its two legs 50 and 50' are both in their respective first positions and are placed under respective ones of the two folding portions 30 and 30' of the tabletop 10 in their respective unfolded configurations.

Since, in this example, the two legs 50 and 50' are identical, the vertical distance between the tabletop 10 and the second end 54 of the first leg 50 (which end is then the end facing towards the floor) is identical to the vertical distance between the tabletop 10 and the second end of the second leg 50' (which end is then the end facing towards the floor). As a result, the top face of the tabletop 10 can be horizontal when the floor on which the table is stood is also horizontal.

It can be observed firstly that this first in-use configuration of the table corresponds to the two legs 50 and 50' being spaced apart from each other to the largest extent in the longitudinal direction of the table, and secondly that this spacing distance between the two legs 50 and 50' does not depend on the longitudinal dimensions of the first and second folding portions 30 and 30'.

In addition, as shown in FIG. 5, the table is also suitable for taking up a stable position in a second in-use configuration or "console table" configuration that is obtained when both of its legs 50 and 50' are in their respective second positions and when both of the folding portions 30 and 30' of its tabletop 10 are in their respective folded configurations.

Since, in this example, the two legs 50 and 50' are identical, the vertical distance between the tabletop 10 and the first end 52 of the first leg 50 (which end is then the end facing towards the floor) is identical to the vertical distance between the tabletop 10 and the first end of the second leg 50' (which end is then the end facing towards the floor). As a result, the top face of the tabletop 10 can be horizontal when the floor on which the table is stood is also horizontal.

In the example shown, this console table configuration is advantageous because the two legs 50 and 50' find themselves under the support portion 20 when they are in their respective second positions, thereby making it possible to fold the two folding portions 30 and 30' of the tabletop 10.

By then standing the table on the floor in such a manner that the first end 52 of the first leg 50 and the first end of the second leg 50' both bear against the floor, the support portion 20 forms the usable surface of a console table on which articles can be placed and that is of maximum compactness in the longitudinal direction of the table.

Figure 6:
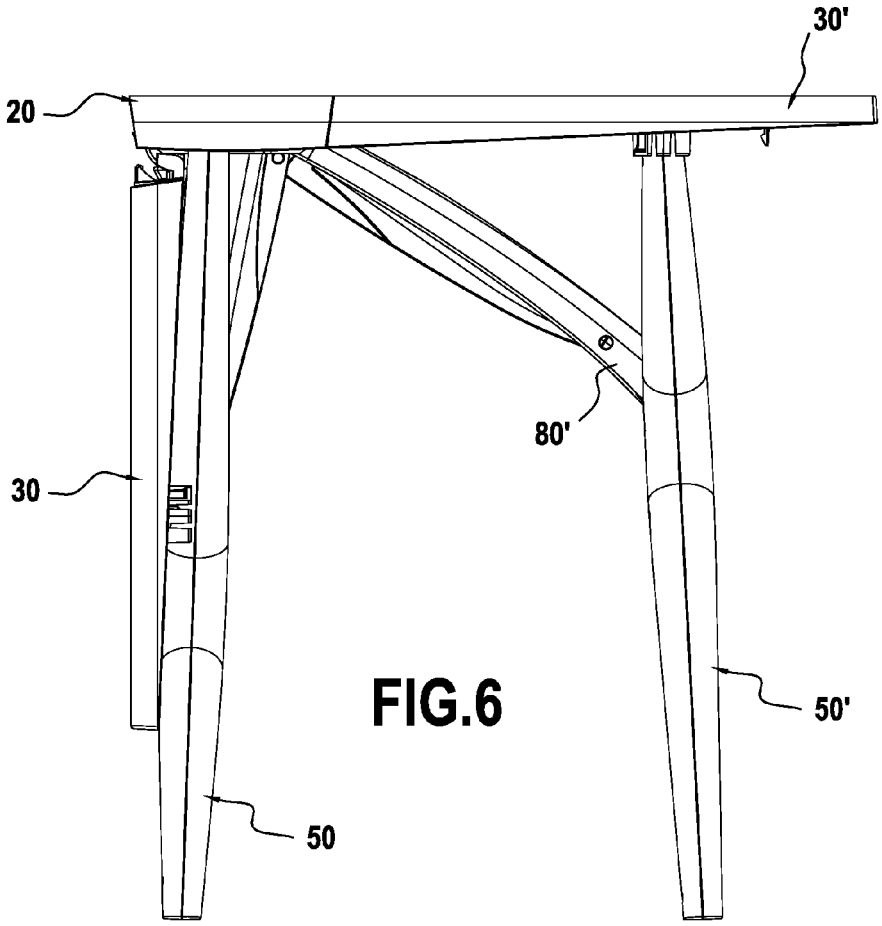
FIG. 6 is a side view of the above table, in which view the first and second legs are respectively in the second position and in the first position, and the first and second folding portions of the tabletop are respectively in the folded configuration and in the unfolded configuration.

In addition, as shown in FIG. 6, the table is also suitable for taking up a stable position in an "intermediate" third configuration, in which the two legs 50 and 50' are disposed top-to-tail.

In other words, this intermediate configuration is obtained when one of the two legs is in its first position, while the other of the two legs is in its second position.

The folding portion of the tabletop that is associated with said one of the two legs then takes up its unfolded configuration, while the other folding portion that is associated with said other of the two legs can take up its folded configuration.

In the example shown, it is the second leg 50' that is in its first position, while the first leg 50 is in its second position. In addition, it is the second folding portion 30' that takes up its unfolded configuration, while the first folding portion 30 takes up its folded configuration.

The dimensions of the first connecting strut 80 and of the first leg 50, and the locations of the first and second axes X1 and X2 are adapted in such a manner that the vertical distance between the tabletop 10 and the second end 54 of the first leg 50 in its first position is substantially equal to the vertical distance between the tabletop 10 and the first end 52 of the first leg 50 in its second position.

In this example, since the second leg 50' is also a moving leg, said second leg must have the same characteristic so as to enable the table to be stable in this intermediate configuration, and, in the example shown, it does indeed have the same characteristic because the second leg 50' and the second connecting strut 80' are respectively identical to the first leg 50 and to the first connecting strut 80.

The vertical distance between the tabletop and the end of the first leg 50 that is facing towards the floor (its first end in the example shown in FIG. 6) is substantially equal to the vertical distance between the tabletop and the end of the second leg 50' that is facing towards the floor (its second end in this example). As a result, the top face of the tabletop can be horizontal when the floor on which the table is stood is also horizontal.

In addition, as shown in particular in FIG. 9, the place where the first connecting strut 80 is connected to the first leg 50 is situated not exactly half-way up said leg (equidistantly between its first end 52 and its second end 54).

In this example, provision is made for the first connecting strut 80 to be connected to the first leg 50 at a place thereon that is closer to its first end 52 than to its second end 54.

In other words, the distance between the first end 52 of the first leg 50 and the location thereon that embodies the second axis X2 is less than the distance between the second end 54 of the first leg 50 and said location.

It can be understood that this characteristic contributes to obtaining a vertical distance between the tabletop 10 and the second end 54 of the first leg 50 in its first position that is substantially equal to the vertical distance between the tabletop 10 and the first end 52 of the first leg 50 in its second position.

In the example shown, the first leg 50 is substantially parallel to the first connecting strut 80 when the first leg 50 takes up its second position.

In other words, the first leg 50 in its second position forms an angle with the first connecting strut 80 that is close to 0°, e.g. equal to 0°±10°.

As a result, in this example, a first plane P1 passing through the first and second ends 52 and 54 of the first leg 50 is substantially parallel to a second plane P2 passing through the first and second pivot axes X1 and X2. These two planes then form between them an angle that is close to 0°, e.g. equal to 0°±10°.

In the example shown, the first leg 50 is substantially vertical when the first leg 50 takes up its second position. The first plane P1 is then substantially vertical when the first leg 50 takes up its second position.

Similarly, the first connecting strut 80 is substantially vertical when the first leg 50 takes up its second position. The second plane P2 is then substantially vertical when the first leg 50 takes up its second position.

In addition, in the example shown, the first connecting strut 80 forms an oblique angle A with the vertical direction when the first leg 50 takes up its first position, e.g. an angle of 55°±10°. The second plane P2 then forms an oblique angle A with a vertical plane when the first leg 50 takes up its first position.

In addition, the first leg 50 is substantially vertical when it takes up its first position. The first plane P1 is then substantially vertical when the first leg 50 takes up its first position.

The first plane P1 and the second plane P2 therefore form an oblique angle in this example.

It results from the characteristics of this example that the distance between the second end 54 of the first leg 50 and the place thereon where it is connected to the first connecting strut 80 (i.e. the location on the first leg 50 that embodies the second axis X2) must have a value close to, e.g. different by less than 20% relative to, the spacing between the axes of the first connecting strut 80 (i.e. the distance between the first axis X1 and the second axis X2).

Similarly, the distance between the first end 52 of the first leg 50 and the place thereon where it is connected to the first connecting strut 80 must have a value close to, e.g. different by less than 20% relative to, the value of the product of this spacing between the axes multiplied by the cosine of the oblique angle A.

Figure 13:
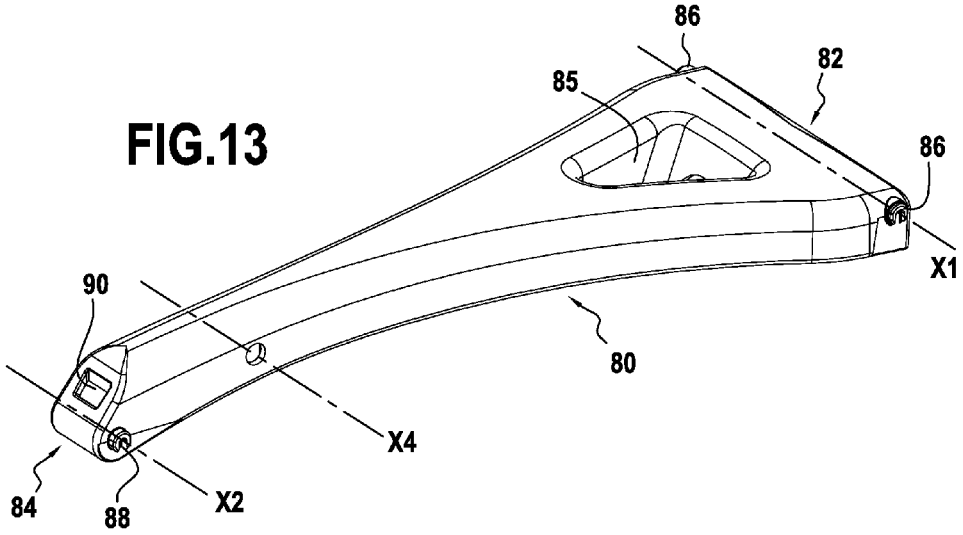
FIG. 13 is a perspective view of a connecting strut of the above table.
Figure 15:
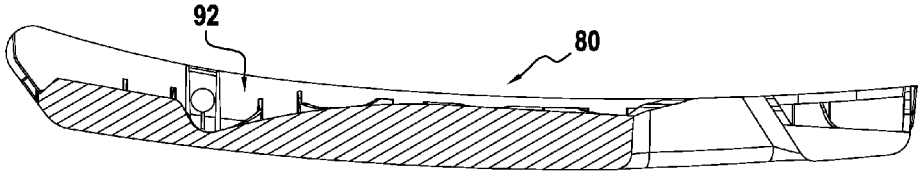
FIG. 15 is a section view of said connecting strut on the axis XV-XV shown in FIG. 14.
Figure 14:
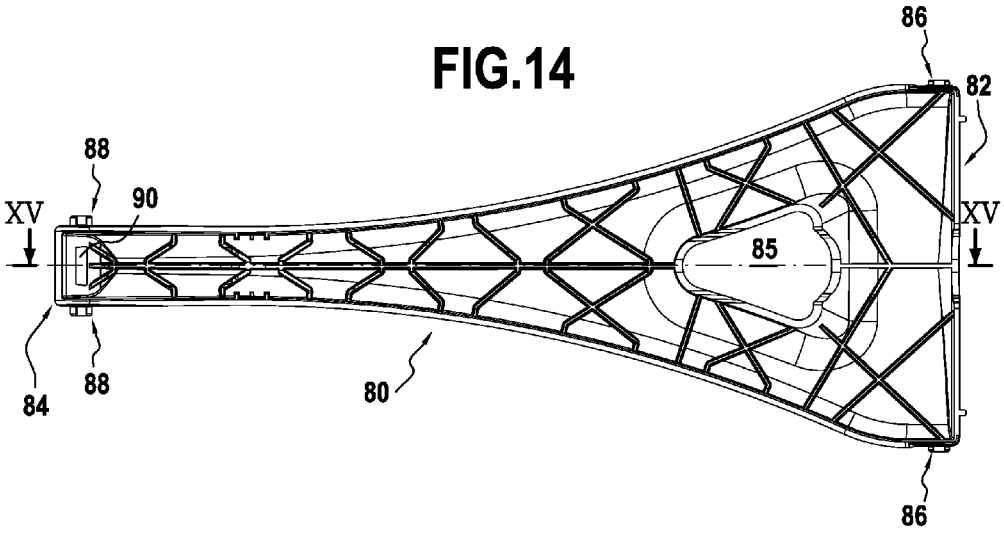
FIG. 14 is a view seen from below of the connecting strut shown in FIG. 13.

As shown in particular in FIGS. 13 to 15, the first connecting strut 80 is substantially plane, or indeed slightly curved.

When the first connecting strut 80 is assembled to the tabletop 10, the width of the first connecting strut 80 in the lateral direction of the table varies going from its first end 82, which is the place of largest width on the first connecting strut 80, to its second end 84, which is the place of smallest width on the first connecting strut 80.

However, it is possible, without going beyond the ambit of the present invention, to provide a connecting strut 80 of width that is substantially constant in the lateral direction.

The widest portion of the first connecting strut 80 is provided with a slot 85 extending through its entire thickness in such a manner as to optimize the weight of said connecting strut 80.

The first end 82 of the first connecting strut 80 is mounted to pivot on the tabletop 10 via a pivot connection having the first axis X1 as its axis.

It can be understood that the larger width presented by the first connecting strut 80 at its first end 82 enables the forces transmitted to it by the tabletop 10 to be taken up better.

In the example shown, this pivot connection is formed by two sleeves 86 that are circularly symmetrical and in alignment with each other, their common axis being the first axis X1.

From respective ones of the two longitudinal walls of the first connecting strut 80, and in the vicinity of its first end 82, these two sleeves 86 project in opposite directions along the lateral direction of the table.

These two sleeves 86 are suitable for being inserted into respective recesses of appropriate dimensions (not shown) that are provided in the tabletop 10, in particular in its support portion 20.

It can be understood that the two longitudinal walls of the first connecting strut 80, from which walls the two sleeves 86 respectively project, can advantageously act as axial abutments preventing any movement in translation of the first connecting strut 80 relative to the tabletop 10 in the same direction as the first axis X1.

In addition, these two sleeves 86 are split radially, thereby making them springy to facilitate assembly and disassembly of the first connecting strut 80 relative to the tabletop 10.

In addition, the second end 84 of the first connecting strut 80 is mounted to pivot on the first leg 50 via a pivot connection having the second axis X2 as its axis.

In the example shown, this pivot connection is formed by two sleeves 88 that are circularly symmetrical and in alignment with each other, their common axis being the second axis X2.

From respective ones of the two longitudinal walls of the first connecting strut 80, and in the vicinity of its second end 84, these two sleeves 88 project in opposite directions along the lateral direction of the table.

These two sleeves 88 are suitable for being inserted into respective ones of two recesses 62 of appropriate dimensions that are provided in the first leg 50.

The two sleeves 88 are split radially for reasons analogous to those mentioned above.

As shown in FIGS. 4 and 9, the first leg 50 has a setback 60 in which at least a portion of the first connecting strut 80 is received when the first leg 50 takes up its second position.

This setback 60 is formed in the central portion 58 of the first leg 50.

The portion of the first connecting strut 80 that is of smallest width is adapted to being received in said setback 60 when the first leg 50 takes up its second position.

It can therefore be understood that the smaller width presented by the first connecting strut 80 at its second end 84 enables the portion of the first connecting strut 80 that is received in the setback 60 to be compact, so that the central portion 58 of the first leg 50 can also be compact.

It can also be observed that, by means of this recess that receives a portion of the connecting strut 80 inside the setback 60 of the first leg 50, the above-defined first and second planes P1 and P2 may be substantially or almost coplanar.

As a result, when the first leg 50 takes up its second position, the compactness of the assembly constituted by the first leg 50 and by the first connecting strut 80 can be maximized in the longitudinal direction of the table, without hindering substantially vertical positioning of the first leg 50 and/or of the first connecting strut 80.

The place where the first connecting strut 80 is connected to the first leg 50 is situated inside the setback 60 in the first leg 50.

More precisely, the two recesses 62 suitable for receiving respective ones of the two sleeves 88 are provided in the two longitudinal walls of the setback 60 that are spaced apart in the lateral direction.

It can be understood that this example thus represents a particular solution for implementing a connection between the first connecting strut 80 and the first leg 50 at a place thereon that is situated between its first and second ends 52 and 54 and at some distance therefrom.

As a result, the first and second ends 52 and 54 of the first leg 50 are both spaced apart from the second horizontal axis X2 via which the first connecting strut 80 is connected to the first leg 50, so that said two ends 52 and 54 are both suitable for describing circular paths within the reference frame of the first connecting strut 80 while the first leg 50 is pivoting about the second axis X2 of the first connecting strut 80.

In addition, the table may advantageously but not necessarily be provided with one or more means for reinforcing its rigidity in a given configuration.

Figure 8:
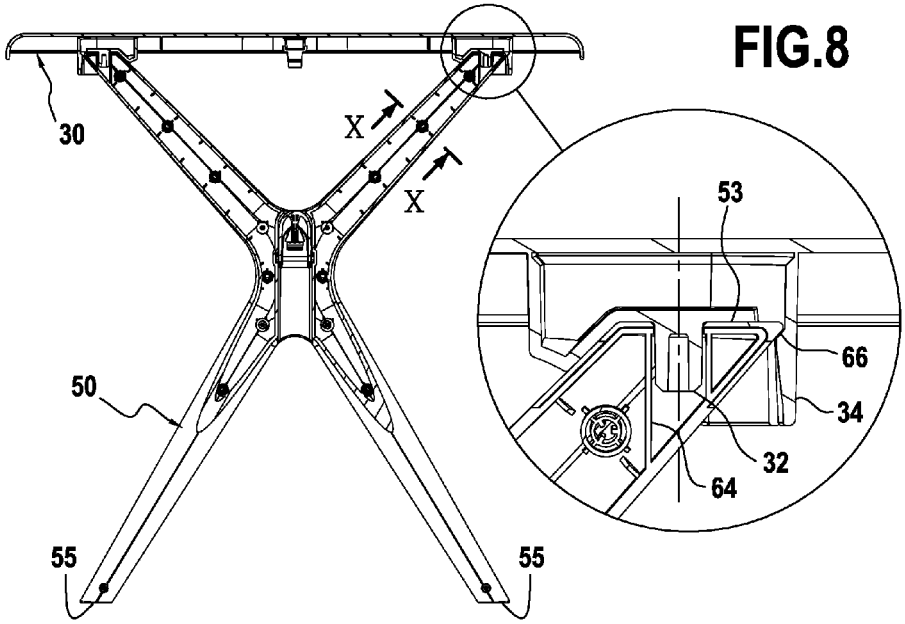
FIG. 8 shows a section view on the axis VIII-VIII shown in FIG. 7, and a detail view of keying means for keying the first end of the moving leg in its first position.
Figure 12:
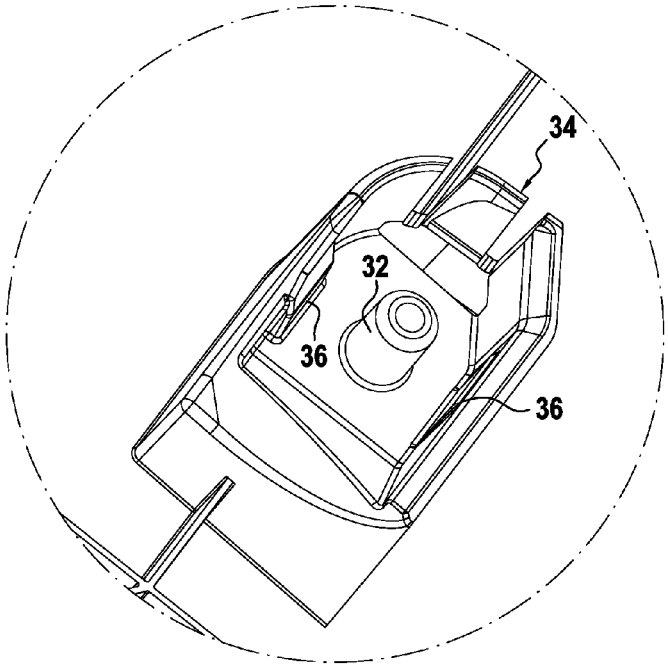
FIG. 12 is a perspective view of the detail XII marked in FIG. 11.

For example, as shown in particular in FIGS. 8, 11, and 12, the table may advantageously be provided with keying means for keying the first end 52 of the first leg 50 relative to the tabletop 10, when the first leg 50 is in its first position.

In this example, these keying means comprise "horizontal" keying means configured to key the first end 52 of the first leg 50 relative to the tabletop 10 in one or more horizontal directions; and "vertical" keying means configured to key said first end 52 in the vertical direction, when the first leg 50 takes up its first position.

More precisely, the horizontal keying means comprise at least one pair of horizontal keying members constituted by a projection 32 provided on one of the elements chosen from among the tabletop 10 and the first end 52 of the first leg 50, and a slot 64 that is provided in the other of said elements and that is suitable for co-operating with the projection 32 to key the first end 52 of the first leg 50 relative to the tabletop 10 in one or more horizontal directions, when the first leg 50 is in its first position.

This pair of horizontal keying members constitute pieces in relief enabling the first end 52 of the first leg 50 in its first position to be keyed in one or more horizontal directions.

In the example shown, the first leg 50 is placed under the first folding portion 30 of the tabletop 10 when it takes up its first position.

The projection 32 is therefore formed on one of the elements chosen from among the first folding portion 30 of the tabletop 10 and the first end 52 of the first leg 50, while the slot 64 is provided in the other of said elements.

In the example shown, it is the tabletop 10 that is provided with the projection 32 and the first end 52 of the first leg 50 that is provided with the slot 64.

In addition, the shape of the projection 32 and the shape of the slot 64 are adapted in such a manner that the first end 52 of the first leg can be keyed in any horizontal direction, in particular simultaneously in the lateral and the longitudinal directions of the table.

To this end, in this example, the projection 32 and the slot 64 are each chosen to be circularly symmetrical about a vertical axis.

The projection 32 consists of a positioning or centering stud, while the slot 64 consists of a bore.

In the example shown, the horizontal keying means have as many pairs of horizontal keying members as the first end 52 of the first leg has bearing surfaces 53, in such a manner as to key each of said bearing surfaces 53 horizontally relative to the tabletop 10.

Thus, in the example shown, the horizontal keying means comprise two pairs of horizontal keying members that are associated with respective ones of the two bearing surfaces 53 of the first end 52 of the first leg 50, in such a manner as to key each of said two bearing surfaces 53 relative to the tabletop 10.

In this example, two slots 64 are provided in respective ones of the two bearing surfaces 53 of the first end 52 of the first leg 50, and they are suitable for co-operating with respective ones of two projections 32 that project from the bottom face of the first folding portion 30 of the tabletop 10, when the first leg 30 is in its first position disposed under the first folding portion 30 in its unfolded configuration.

In addition, the vertical keying means comprise at least one pair of vertical keying members constituted by a resilient contact portion 34 provided on one of the elements chosen from among the tabletop 10 and the first end 52 of the first leg 50, and a keying surface 66 that is provided on the other of said elements and that is suitable for co-operating with the resilient contact portion 34 to key the first end 52 of the first leg 50 vertically relative to the tabletop 10 in the first position.

This pair of vertical keying members constitute pieces in relief enabling the first end 52 of the first leg 50 in its first position to be keyed in the vertical direction.

In the example shown, the first leg 50 is placed under the first folding portion 30 of the tabletop 10 when it takes up its first position.

The resilient contact portion 34 is therefore formed on one of the elements chosen from among the first folding portion 30 of the tabletop 10 and the first end 52 of the first leg 50, while the keying surface 66 is provided on the other of said elements.

In the example shown, the resilient contact portion 34 is such that, starting from a rest position in which it co-operates with the keying surface 66 to retain the first end 52 of the first leg 50 in the vertical direction when said first leg 50 is in its first position, the contact portion 34 is suitable for being moved away from the keying surface 66 by resilience in order to release the first end 52 of the first leg 50.

In this example, the resilient contact portion 34 co-operates with the keying surface 66 in a plane parallel to the longitudinal direction of the table.

In the example shown, the tabletop 10 is provided with the resilient contact portion 34 and the first end 52 of the first leg 50 is provided with the keying surface 66.

More precisely, the resilient contact portion 34 consists of a resilient tongue that projects under the tabletop 10, in particular under the first folding portion 30 thereof.

In the example shown, the vertical keying means have as many pairs of vertical keying members as the first end 52 of the first leg 50 has bearing surfaces 53, in such a manner as to key each of said bearing surfaces 53 vertically relative to the tabletop 10.

Thus, in the example shown, the vertical keying means comprise two pairs of vertical keying members that are associated with respective ones of the two bearing surfaces 53 of the first end 52 of the first leg 50, in such a manner as to key each of said two bearing surfaces 53 relative to the tabletop 10.

In this example, each of the two keying surfaces 66 is formed by a portion of a peripheral wall extending around the associated bearing surface 53, this portion extending in the close vicinity of said bearing surface 53 and from that longitudinal end thereof that is further from the other bearing surface 53 in the lateral direction.

In addition, the horizontal keying means may further comprise one or more abutments 36 that project from the tabletop 10 and that are suitable for keying the first end 52 of the first leg 50 in a horizontal direction, when the first leg 50 takes up its first position.

In the example shown, in particular in FIG. 12, each of the two bearing surfaces 53 defining the first end 52 of the first leg 50 is keyed in the longitudinal direction of the table by two abutments 36 that are spaced apart in the longitudinal direction and between which the peripheral wall around said bearing surface 53, in the vicinity thereof, comes to be positioned when the first leg 50 takes up its first position.

At least one of said two abutments 36, and preferably at least that one of them that is further from the first axis X1 in the longitudinal direction, has a ramp portion in such a manner as also to provide a function of guiding the movement of the leg 50 as it reaches or as it leaves its first position.

In addition, as described above, in the example shown, the tabletop 10, and in particular its support portion 20, bears against the second end 54 of the first leg 50, when said first leg takes up its second position.

In this example, it is chosen for the tabletop 10 merely to rest on said second end 54, when the first leg 50 is in its second position.

More precisely, the two bearing surfaces 55 of the first leg 50 that define its second end 54 merely come into contact with the support portion 20 of the tabletop 10, in particular with contact surfaces 28 that project from the bottom face of the support portion 20 in such a manner as to adjust the height of the place of contact of the support portion 20 with the two bearing surfaces 55.

However, it is possible, without going beyond the ambit of the present invention, to make provision for the table to include keying means for keying the second end 54 of the first leg 50 relative to the tabletop 10 when the first leg 50 is in its second position.

Such keying means may advantageously be analogous to the above-described means so as to key the first end 52 of the first leg 50 in its first position.

It can thus be understood that keying means for keying the second end 54 of the first leg 50 relative to the tabletop 10 in its second position may, by analogy, advantageously have one or more of all of the characteristics that are described above regarding the horizontal keying means and the vertical keying means for keying the first end 52 of the first leg 50 in its first position.

Figure 16:
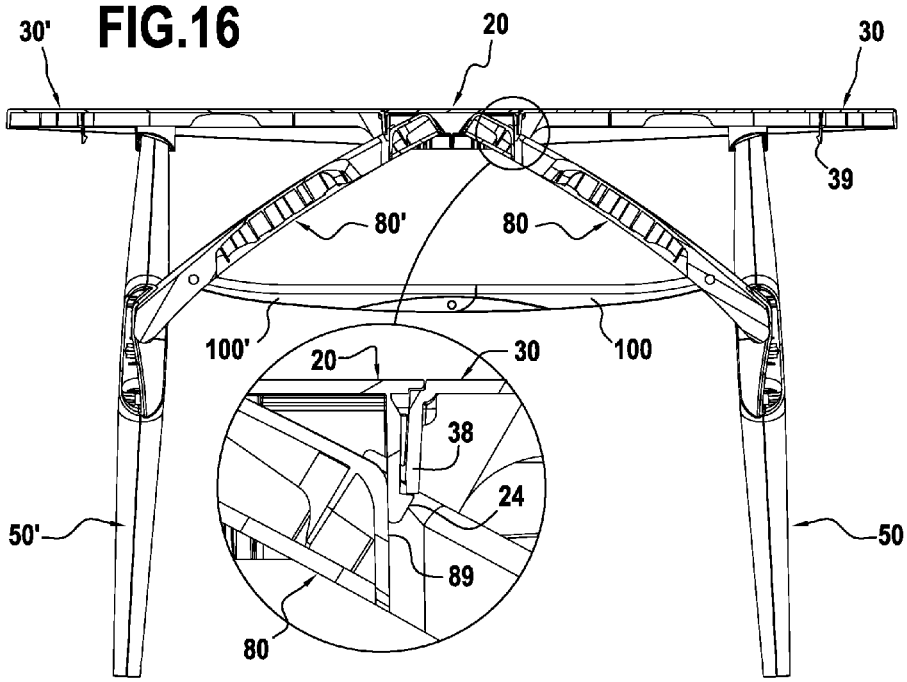
FIG. 16 shows a section view on the axis XVI-XVI shown in FIG. 7, and a detail view that shows the means for securely retaining a folding portion of the tabletop in its unfolded position.

In addition, as shown in FIG. 16, the table is provided with means for securely retaining the first folding portion 30 in its unfolded configuration.

In particular, these secure retaining means comprise a locking device including a member 38 that is stationary relative to one of the elements chosen from among the first folding portion 30 and the support portion 20, and another member 24 mounted to move on the other of said elements, in such a manner that, starting from a locking configuration in which the moving member 24 co-operates with the stationary member 38 to lock the first folding portion 30 in its unfolded configuration, the moving member 24 is suitable for being moved so as to take up an unlocking configuration in which the moving member 24 is released.

In the example shown, the stationary member 38 is stationary relative to the first folding portion, while the moving member 24 is mounted on the support portion 20.

More precisely, the stationary member 38 is formed by a vertical skirt presented by the first folding portion 30 and that extends in the lateral direction of the table.

The moving member 24 consists of a resilient contact portion, in particular a resilient tongue, that advantageously projects from the support portion 20.

This resilient contact portion is such that, starting from a rest position in which the resilient contact portion co-operates with the vertical skirt to lock the first folding portion 30 in its unfolded configuration, the resilient contact portion is suitable for being moved away from the vertical skirt so as to adopt an unlocking configuration in which the resilient contact portion is released.

In order to reinforce the secure retaining of the first folding portion 30 in its unfolded configuration, the secure retaining means may advantageously further comprise a secure retaining member 89 that is mounted to move relative to the moving member 24, in such a manner that, starting from a secure retaining position in which the secure retaining member 89 co-operates with the moving member 24 for securely retaining the locking device in its locking configuration, the secure retaining member 89 is suitable for being moved to leave this secure retaining position and to release the moving member 24.

In the example shown, the secure retaining member 89 is integral with or secured to the first connecting strut 80.

The secure retaining position of the secure retaining member 89 is obtained when the first connecting strut 80 takes up the particular position that it takes up when the first leg 50 takes up its first position.

In the example shown, the secure retaining member 89 comes into contact with the resilient contact portion in such a manner as to prevent said resilient contact portion from moving away from the vertical skirt, thereby securely retaining the resilient contact portion in its locking configuration.

More precisely, the secure retaining member 89 consists of a portion of the peripheral wall of the slot 85 in the first connecting strut 80 that is suitable for coming to bear against the resilient contact portion.

Figure 17:
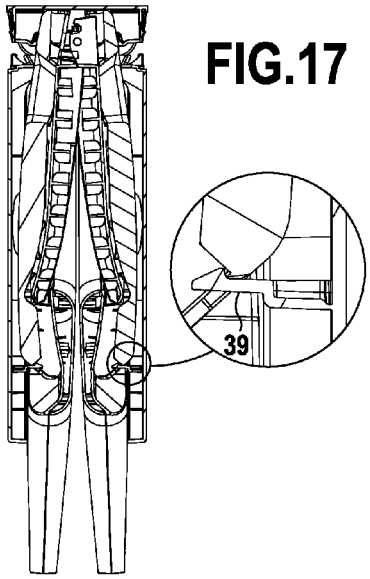
FIG. 17 shows a section view on the axis XVII-XVII shown in FIG. 7, and a detail view that shows the means for securely retaining a folding portion of the tabletop in its folded position.
Figure 18:
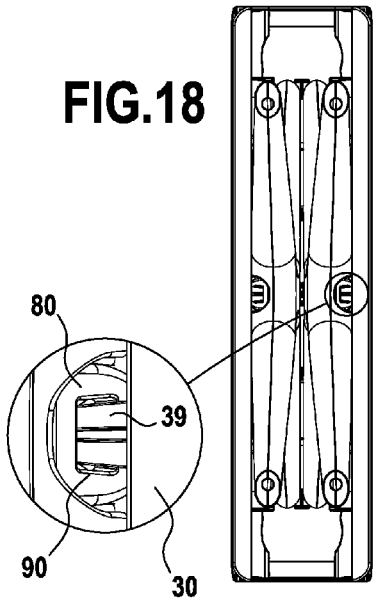
FIG. 18 is a view from below of the above table, with the two folding portions of its tabletop in their folded configurations.

In addition, as shown in FIGS. 17 and 18, the table is provided with means for securely retaining the first folding portion 30 in its unfolded configuration.

In particular, these means comprise a first secure retaining element 39 that is provided on one of the elements chosen from among the first folding portion 30 and the first connecting strut 80, and a second secure retaining element 90 that is provided on the other of said elements and that is suitable for co-operating with the first secure retaining element 39 in order to hold the first folding portion 30 in its folded configuration, when the first leg 50 takes up its second position.

In the example shown, the first secure retaining element 39 consists of a clipping catch (see, for example, FIGS. 2 and 6), while the second secure retaining element 90 consists of a clipping slot suitable for co-operating with the clipping catch.

In addition, it is chosen for the clipping catch to be integral with or secured to the first folding portion 30 in such a manner as to project at a place thereon that comes into direct register with a portion of the first connecting strut 80, when the first leg 50 takes up its second position and when the first folding portion 30 takes up its folded configuration, and for the clipping slot to be formed in said portion of the first connecting strut 80 in such a manner as to receive the clipping catch.

In the example shown, said portion of the first connecting strut in which the clipping slot is provided corresponds to the narrowest portion of the first connecting strut 80, in the vicinity of its second end 84.

Although this solution imparts less rigidity than the above-described solution, it is also possible, without going beyond the ambit of the present invention, for the first secure retaining element to be integral with or secured to one of the elements chosen from among the first folding portion and the first leg 50, and for the second secure retaining element to be integral with or secured to the other of said elements.

Figure 19:
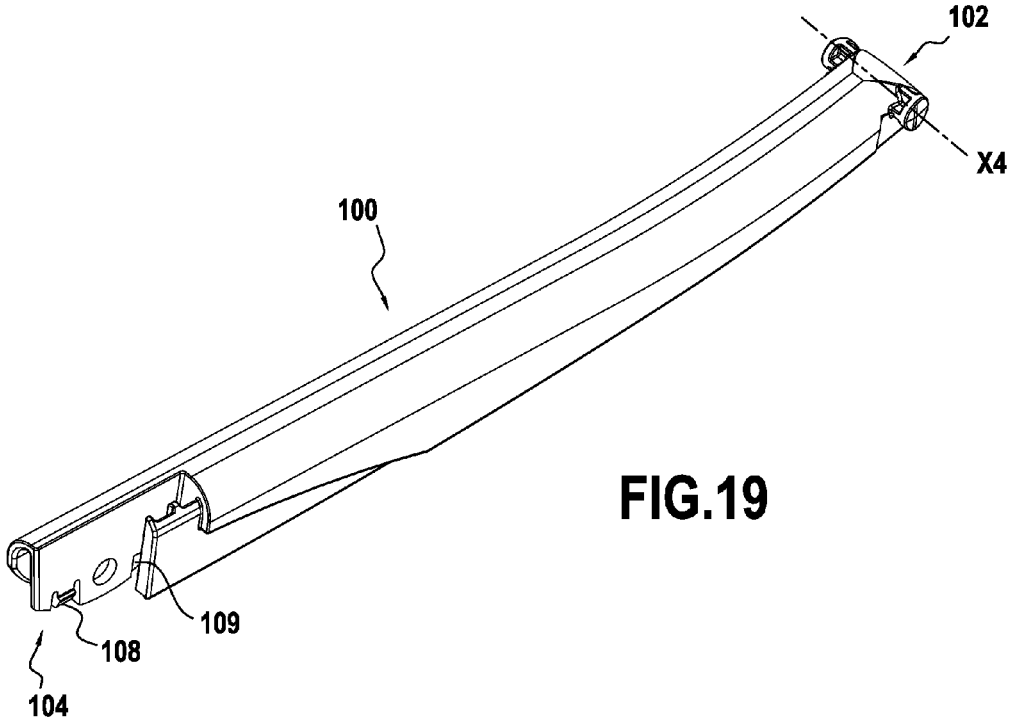
FIG. 19 is a perspective view of one of the two branches of the scissor-type stay of the above table.
Figure 20:
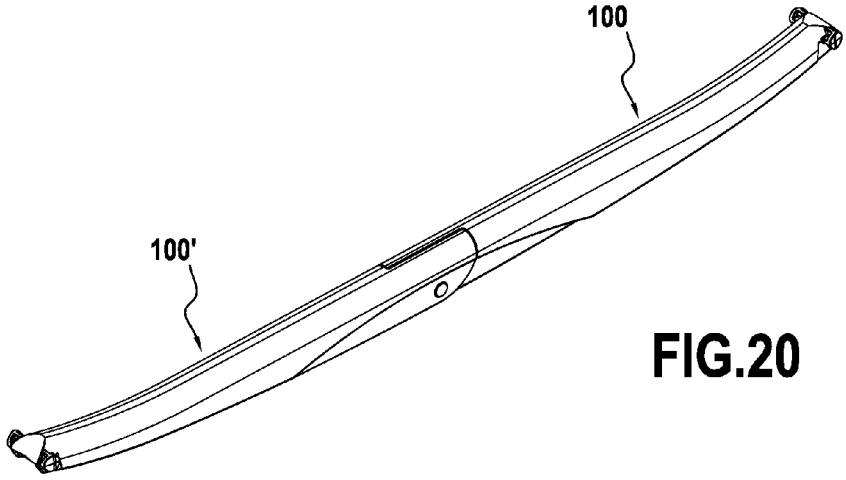
FIG. 20 is a perspective view of the two branches of the scissor-type stay as assembled, in its splayed-out configuration.

In addition, as shown in particular in FIGS. 16, 19, and 20, the table is provided with a scissor-type stay having two branches 100 and 100' suitable for being splayed out respectively between the first leg 50 in its first position and the second leg 50' in its first position in order to hold said legs 50 and 50' apart.

In the example shown, the two branches 100 and 100' of the scissor-type stay are mounted to pivot respectively on the first connecting strut 80 and on the second connecting strut 80'.

Figure 7:
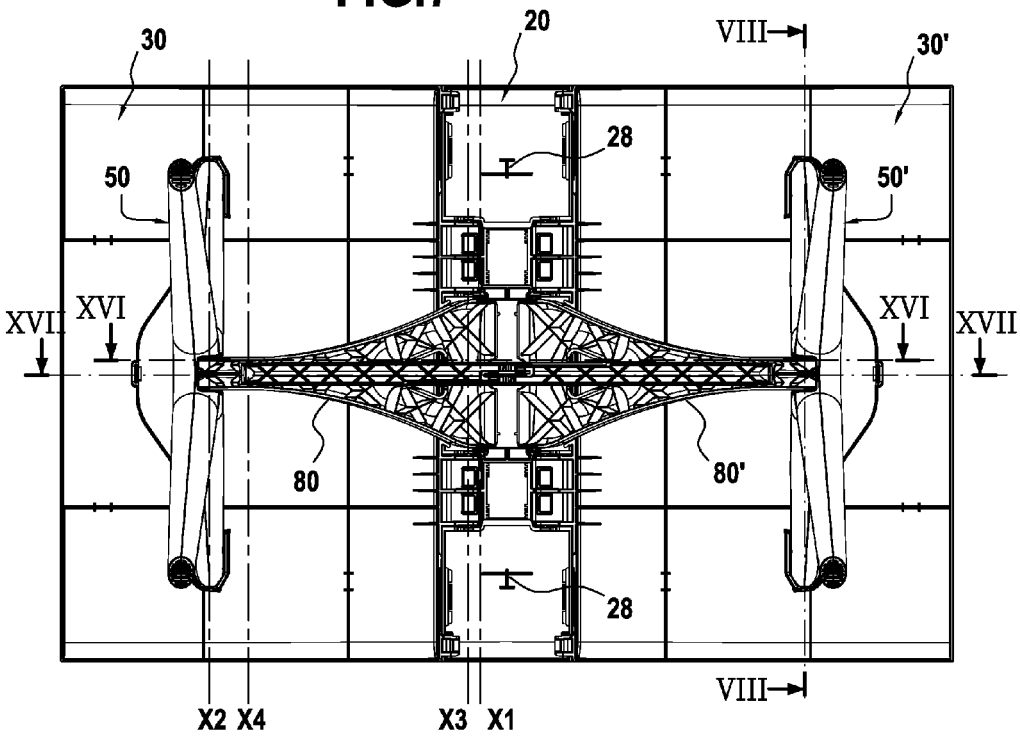
FIG. 7 is a view seen from below of the above table, with both of its legs in their first positions.

More precisely, a first end 102 of the first branch 100 is connected to the first connecting strut 80 via a fourth axis X4 parallel to the second axis X2 (see FIG. 7).

Although it is not excluded from the ambit of the present invention for the fourth axis X4 to coincide with the second axis X2 of the first connecting strut 80, it is chosen in this example for the fourth axis X4 to be spaced apart from the second axis X2.

In other words, the connection between the first branch 100 and the first connecting strut 80 is formed at a place thereon that is spaced apart from its place where it is connected to the first leg 50.

It is also chosen for the distance between the fourth axis X4 and the second axis X2 to be smaller than the distance between the fourth axis X4 and the first axis X1.

As shown in FIG. 17, the first branch 100 of the scissor-type stay comes to bear against the first connecting strut 80 when the first leg 50 takes up its second position so as to maximize the compactness of the assembly made up of the first connecting strut 80 and of first branch 100.

In order to optimize this compactness further, the first connecting strut 80 has a setback 92 in which at least a portion of the first branch 100 of the scissor-type stay is received when the first leg 50 takes up its second position (see FIG. 15).

In this example, a portion of the first branch 100 starting from its first end 102 is received in part inside said setback 92 when the first leg 50 takes up its second position.

The place at which the first connecting strut 80 is connected to the first branch 100 is situated inside said setback 92.

In the example shown, the second branch 100' is identical to the first branch 100, so that the second branch 100' may advantageously, by analogy, have one or more of all of the characteristics described in association with the first branch 100.

Thus, the second branch 100' is mounted to pivot on the second connecting strut 80' of the second leg 50'.

The second end 104 of the first branch 100 is connected to the second end of the second branch 100' via a pivot connection in such a manner that said two branches 100 and 100' can pivot relative to each other so as to be brought together, when at least one of the legs chosen from among the first leg 50 and the second leg 50' takes up its second position, or splayed out, when the two legs 50 and 50' both take up their respective first positions.

In addition, provision is made for the scissor-type stay to have a hard spot for holding its two branches 100 and 100' in their splayed-out position between the first and second legs 50 and 50'.

In the example shown, this hard spot is formed by means of a clipping catch 108 and of a clipping slot 109 that are formed in the vicinity of the second end 104 of the first branch 100 and that are suitable for co-operating respectively with the clipping slot and with the clipping catch with which the second branch 100' is provided.

In addition, in the example shown, each of the elements chosen from among the first leg 50, the first connecting strut 80, the first folding portion 30 of the tabletop 10, the first branch 100 of the scissor-type stay, the support portion 20 of the tabletop, the second leg 50', the second connecting strut 80', the second folding portion 30' of the tabletop 10, and the second branch 100' of the scissor-type stay is an element that is dissociated from the other elements and that is made of a plastics material, in particular by injection molding.

This characteristic is advantageously used to optimize the weights of these elements.

Thus, the first leg 50 is formed by assembling together two hollow pieces 50A and 50B that subdivide the first leg 50 in a plane passing through its first end 52 and its second end 54. As shown in FIGS. 9 and 10, these two hollow pieces 50A and 50B are assembled together by male elements 51*a* provided on one of the two pieces 50A and 50B co-operating with female elements 51*b* provided in the other piece, and by fastening screws.

In addition, as shown in FIG. 14, the first connecting strut 80 is also a hollow piece, which is advantageously ribbed.

The same applies for the first branch 100 of the scissor-type stay, as shown, for example, in FIGS. 3 and 7.

In addition, in the example shown, the table has two legs, both of which are moving legs.

However, without going beyond the ambit of the present invention, it is possible to provide a table having an entirely different number of legs, greater than two, e.g. three, four, or more legs, with the sole proviso that the table has at least two legs, at least one of which is a moving leg in the meaning of the present invention.

Each of the legs may be chosen to be stationary, moving in the meaning of the present invention, or moving by describing a movement path other than that of turning over by pivoting about a connecting stay, with the sole proviso that the table has at least one moving leg in the meaning of the present invention.

The invention claimed is:

1. A table comprising:

a tabletop;

at least first and second legs, wherein at least the first leg is a moving leg; and a connecting strut connected to the tabletop at a first horizontal axis and to the first leg at a second horizontal axis;

wherein the first leg is configured to pivot about the second horizontal axis of the connecting strut from a first position defined by a first end and a second end of the first leg facing respectively towards the tabletop and towards the floor, to a second position defined by the first end and the second end of the first leg facing respectively towards the floor and towards the tabletop.

2. A table according to claim 1, further comprising a device for engaging the first end of the first leg relative to the tabletop in the first position.

3. A table according to claim 1, wherein the second end of the first leg contacts the table top in the second position.

4. A table according to claim 1, wherein, in the second position, the first leg is substantially parallel to the connecting strut.

5. A table according to claim 4, the first leg being provided with a setback in which at least a portion of the connecting strut is received when the first leg is pivoted to the second position.

6. A table according to claim 1, the tabletop having a support portion that carries the first horizontal axis of the connecting strut, and at least a first folding portion mounted to pivot relative to the support portion to enable moving between an unfolded configuration in which the first leg is placed under the first folding portion, and a folded configuration in which the first leg is placed under the support portion.

7. A table according to claim 6, the second leg being a moving leg analogous to the first leg, and the tabletop having a second folding portion mounted to pivot relative to the support portion, on a side opposite from the side on which the first folding portion is connected to the support portion to enable moving between an unfolded configuration in which the second leg is placed under the second folding portion and a folded configuration in which the second leg is placed under the support portion.

8. A table according to claim 6, further comprising a device for retaining the first folding portion in the folded configuration.

9. A table according to claim 6, further comprising a device for retaining the first folding portion in the unfolded configuration.

10. A table according to claim 1, further comprising a second connecting strut connected to the tabletop at a third horizontal axis and to the second leg at a fourth horizontal axis, wherein the second leg is configured to pivot about the fourth second horizontal axis of the second connecting strut from a similar first position defined by a similar first end and a similar second end of the second leg facing respectively towards the tabletop and towards the floor, to a similar second position defined by the similar first end and the similar second end of the second leg facing respectively towards the floor and towards the tabletop.

11. A table according to claim 10, the table being in a stable position when the first leg is in the first position while the second leg is in the similar second position, or when the first leg is in the second position while the second leg is in the similar first position.

12. A table according to claim 10, further comprising at least one stay having two branches configured to splay out between the first and second legs in the first position of the first leg and the similar first position of the second leg to hold the first leg and the second leg apart.

13. A table according to claim 12, the two branches of the at least one stay being mounted to pivot respectively on the connecting strut of the first leg and on the second connecting strut of the second leg.

14. A table according to claim 13, the two branches of the at least one stay are configured to contact respectively against the connecting strut of the first leg and against the second connecting strut of the second leg when the first leg is in the second position and the second leg is in the similar second position.

* * * * *